US007104641B2

(12) United States Patent
Wazana et al.

(10) Patent No.: US 7,104,641 B2
(45) **Date of Patent: *Sep. 12, 2006**

(54) RESEALED INK CARTRIDGE AND METHOD OF MANUFACTURE

(75) Inventors: Yoel Wazana, Northridge, CA (US); Joda Paulus, Palmdale, CA (US)

(73) Assignee: Wazana Brothers International, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/882,471

(22) Filed: Jul. 1, 2004

(65) Prior Publication Data

US 2004/0246316 A1 Dec. 9, 2004

Related U.S. Application Data

(63) Continuation of application No. 10/265,448, filed on Oct. 7, 2002, now Pat. No. 6,773,087.

(51) Int. Cl.
*B41J 2/175* (2006.01)

(52) U.S. Cl. ..... 347/86

(58) Field of Classification Search ..... 347/22, 347/28, 84–87; 134/21, 42, 25.1
See application file for complete search history.

(56) References Cited

U.S. PATENT DOCUMENTS 5,495,272 A * 2/1996 Yamaguchi ..... 347/28
5,790,147 A * 8/1998 Hensel ..... 347/28
6,773,087 B1 * 8/2004 Wazana et al. ..... 347/22

* cited by examiner

*Primary Examiner*—Shih-Wen Hsieh
(74) *Attorney, Agent, or Firm*—Lewis Brisbois Bisgaard & Smith LLP; Jon E. Hokanson

(57) ABSTRACT

A resealed inkjet printer cartridge and method of manufacture in which an ink cartridge is reconditioned, recharged and resealed by a process which substantially eliminates "air lock" or interruption of ink flow to the printer head due to entrained air; which provides for welding together recharged cartridge subassemblies without the use of consumable adhesive or glue; and having a keyless cap adapted for use in various keyed cartridge receptacle inkjet printers.

13 Claims, 2 Drawing Sheets

RESEALED INK CARTRIDGE AND METHOD OF MANUFACTURE

This is a continuation of application Ser. No. 10/265,448, filed Oct. 7, 2002, now U.S. Pat. No. 6,773,087.

TECHNICAL FIELD

The present invention relates to improvements in the field of ink cartridge remanufacture in which a previously depleted ink cartridge is reconditioned, recharged and resealed by a process including a centrifugation technique which substantially eliminates "air lock" or interruption of ink flow to the print head due to entrained air, and which provides for the welding together of cartridge subassemblies without the use of consumable adhesive or glue; and having a sterically keyless replacement cap adapted for use in various inkjet printers having sterically keyed ink cartridge receptacles, thereby resulting in improved product performance, increased production efficiency, decreased production cost and greater product utility.

BACKGROUND ART

Ink cartridges for "inkjet" printers typically contain one or more ink reservoirs, a means of supplying ink to a print head which contains a number of ink microchambers each having an orifice or nozzle, and electrical circuitry to control the operation of the nozzles. In a conventional configuration, ink from a reservoir is supplied through a porous element by capillary action or surface tension forces to a print head assembly composed of an array of ink microchambers. The print head typically includes an array of such ink microchambers with each ink microchamber including an ink ejection orifice or nozzle typically on the order of 4 to 6 microns in diameter. In operation, a minute droplet of ink is ejected from the orifice or nozzle in the direction of the paper or media to be printed, and an image is built up of a multitude of such minute droplets. Two methods are commonly used to eject the ink droplet from the orifice: heat displacement and mechanical displacement.

In the heat displacement method, an electrical resistor or heat element is positioned within the ink microchamber adjacent to the ink ejection orifice or nozzle. When electrical current is applied via the control circuit, the resistor temperature increases rapidly to a high temperature causing a vapor bubble to form in the microchamber which pushes ink from the orifice. When the bubbles bursts or collapses the ink droplet is ejected, and more ink is drawn into the ink microchamber by capillary action.

In the mechanical displacement method, a piezo-electric transducer within the ink microchamber is caused to expand by application of electrical current through the control circuit. When the transducer expands it mechanically ejects a droplet of ink from the microchamber orifice or nozzle. When the current is turned off, the piezo-electric transducer contacts drawing more ink into the ink microchamber.

Heretofore a problem has existed in refilling depleted ink cartridges in that the cleaning and recharging or refilling process often resulted in air bubbles being formed in the ink reservoirs and/or the fluid passage(s) to the print head(s) and/or in the ink microchambers of the print head array of the ink cartridge. Such air bubbles sometimes result in interruption of the flow of ink to the ink microchambers of the print head causing it to stop "printing."

It is conventional in the ink cartridge recycling industry for the recharging process to include a centrifugation step.

However, conventionally, the centrifugal force is applied to the cartridge in a direction opposite to the direction from which ink droplets are ejected from the orifices or nozzles of the print head. Typically the centrifugal force is applied so as to cause wash fluid to flow toward a port from which it may exit the cartridge. In many common cartridge designs, the print head and port or ports are located on opposite ends of the ink cartridge. In some cartridge designs the print head is located on one end of the cartridge and the port or ports may be located on the side of the generally cube or rectangular cylinder shaped ink cartridge. Further, there is variety in the design of the internal fluid passages for flow of ink from the reservoir to the print head of ink cartridges. These factors, alone and in combination, contribute to existence of the afore-mentioned "air lock" problem.

The present invention is directed to solving this "air lock" problem by introducing a centrifugation step in the cleaning, reconditioning and recharging or refilling process of a previously depleted ink cartridge body in which air is expelled from the region of the print head of the previously depleted ink cartridge. This is accomplished by centrifuging the cartridge containing a predetermined quantity of water or other ink miscible liquid for a predetermined time in an orientation with the print head facing radially outward or substantially away from the axis of rotation of the rotor to thus force the liquid from the reservoir through the cartridge ink channels to the microchamber arrays of the print head and thence out of the print head through the orifices or nozzles. In other words, the cartridge is oriented in the centrifuge so that during operation the liquid is accelerated through the cartridge in the same direction as is the ink flowing through the cartridge during normal printing operations. This technique results in air entrapped or entrained at any location between the ink reservoir and the microchamber arrays being purged by the liquid and exhausted via the nozzles as the liquid flows into the microchamber arrays and out through the ink ejection orifices or nozzles.

The second problem to which the present invention is directed is replacement of the cartridge cap. It is conventional in the ink cartridge recycling industry to remove the cartridge cap to gain access to the ink reservoirs for cleaning and recharging during a resealing process. Conventionally, the original cap is thereafter affixed to the ink cartridge by means of adhesive or glue. A primary drawback of this method is that there typically is a period of a few to several minutes for bonding to take place during which alignment must be maintained, which increases production time and cost. Further, resealing with adhesive often fuses the sections together, rendering subsequent separation for additional recharging cycles difficult or impossible. A further drawback of the conventional method is that adhesive is a consumable which adds to production costs and cost of the final product. The present invention is directed to solving these problems by providing a recharged and resealed ink cartridge and method of manufacture in which the ink cartridge cap and the ink cartridge body are joined in a matter of seconds rather than minutes without the use of consumable adhesives or glues.

A third drawback in both original equipment as well as conventionally recharged and resealed ink cartridges is that a particular manufacture's inkjet printer requires use of a specially "keyed" ink cartridge for installation into that manufacture's printers. The present invention provides a recharged and resealed ink cartridge with a keyless replacement cap which permits the resealed ink cartridge to be installed and used in a variety of different printers.

DISCLOSURE OF INVENTION

In its several embodiments, the present invention improves the operational performance of ink cartridges which have been recycled or recharged and resealed from components including those from previously depleted ink cartridges, and provides a method whereby this may be accomplished.

It is a primary object of the present invention to provide an improved method of processing, recharging and resealing previously depleted ink cartridges which substantially eliminates "air lock" or interruption of ink flow to and through the print head due to entrained air.

It is yet another object of the present invention to provide an improved method of processing, recharging and resealing previously depleted ink cartridges which substantially eliminates "air lock" or interruption of ink flow to and through the print head due to entrained air that is uniformly reproducible and reliable.

It is a further object of the present invention to provide a recycled or recharged and resealed ink cartridge that has been processed to minimize "air lock" or interruption of ink flow resulting from entrained air.

It is a further object of the present invention to provide a recycled or recharged and resealed ink cartridge from which entrained air has been expelled from the fluid passages in the region of the print head to minimize "air lock" or interruption of ink flow to and through the ink microchambers of the print head.

It is another object of the present invention to provide an improved method of rejoining subassemblies of previously depleted recharged ink cartridges without the use of adhesive.

It is yet another object of the present invention to provide an improved method of rejoining subassemblies of recycled or recharged and resealed ink cartridges that is substantially faster than conventional methods employing adhesive or glue.

An additional object of the present invention is to provide a recharged and resealed ink cartridge which is interchangeable between and may be used in a variety of different inkjet printer manufactures' printers.

It is a further object of the present invention to provide a recycled or recharged and resealed ink cartridge that is resealed by ultrasonic welding.

BRIEF DESCRIPTION OF THE DRAWINGS

Other objects and advantages of the invention will become apparent from the forgoing detailed description taken in connection with the accompanying drawings, in which.

BEST MODE FOR CARRYING OUT THE INVENTION

To illustrate and further describe the embodiments of the present invention, reference will be made to FIGS. 1–6.

Figure 1:
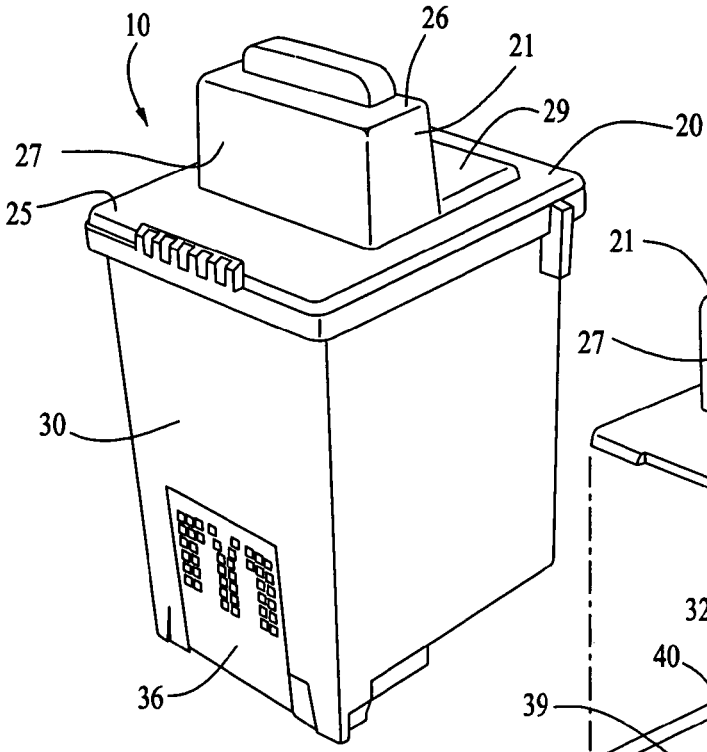
FIG. 1 is a perspective view of an assembled resealed ink cartridge.
Figure 2:
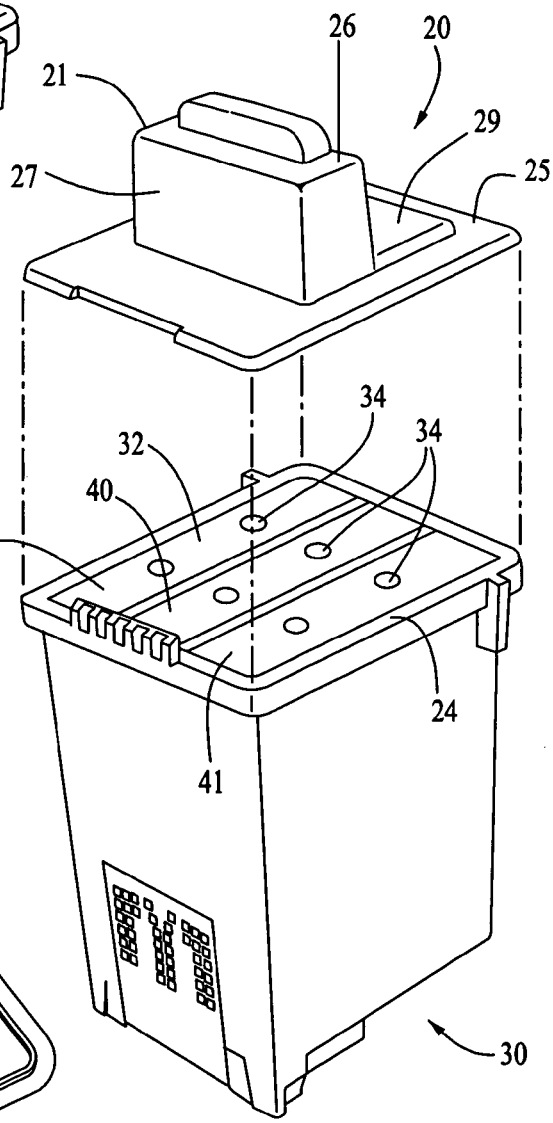
FIG. 2 is a perspective view of a partially disassembled ink cartridge showing the replacement cartridge cap and cartridge body.

FIG. 1 is a perspective view of an assembled ink cartridge (10) to which the electrical contact and conductor board (36) for control of the ink microchamber arrays (not shown) of the print heads (not shown) is affixed. With reference to FIG. 2, the cartridge body (30) includes reservoir sealing plate (32) which covers and closes three primary ink reservoirs (39), (40) and (41), one for each ink color required for full color printing. It will of course be understood that ink cartridges designed to print a single color may have a single primary ink reservoir. Access to each of the primary reservoirs for introduction of ink is provided by ports (34) formed in sealing plate (32).

Figure 6:
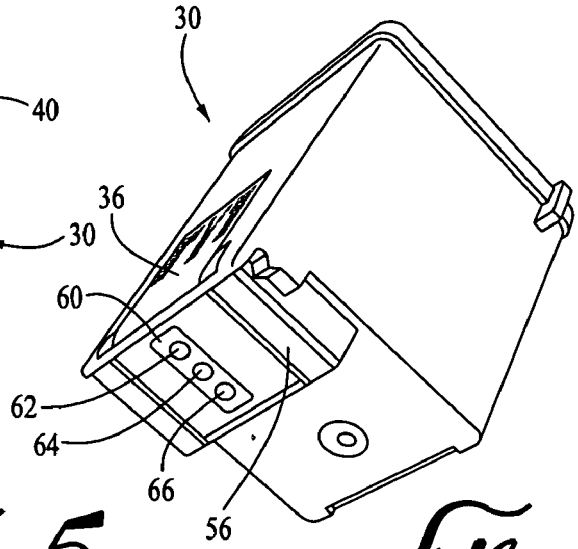
FIG. 6 is a perspective view of a representative ink cartridge showing the print head assembly.

With reference to FIG. 6, the print head assembly (60) disposed on mounting surface (56) contains three print heads (62), (64) and (66), one for each of the three ink colors. A print head is includes an array of ink microchambers each of which has an ink ejection orifice or nozzle as described above. Now with reference to FIG. 5, the three microchamber arrays or print heads (64), (66) and (62) are each in fluid communication with one of the porous elements (50), (52) and (54), respectively, which are disposed adjacent to mounting surface (56) within and spanning ink channels (44), (46) and (42), respectively. Primary ink reservoirs (39), (40) and (41) are in fluid communication with ink channels (44), (42) and (46), respectively. As used herein, the term fluid communication means that a fluid, such as a liquid, may flow or move between the elements mentioned. For example, there is fluid communication between the fuel tank and carburetor of an automobile. The specific configuration of reservoirs, channels and print heads may vary between the differing styles and types of ink cartridges of various original manufacturers. However, the general plumbing configuration scheme described for a common cartridge design here may equally be applied to other ink cartridges which may be reprocessed, recharged and resealed according to the present invention.

Figure 4:
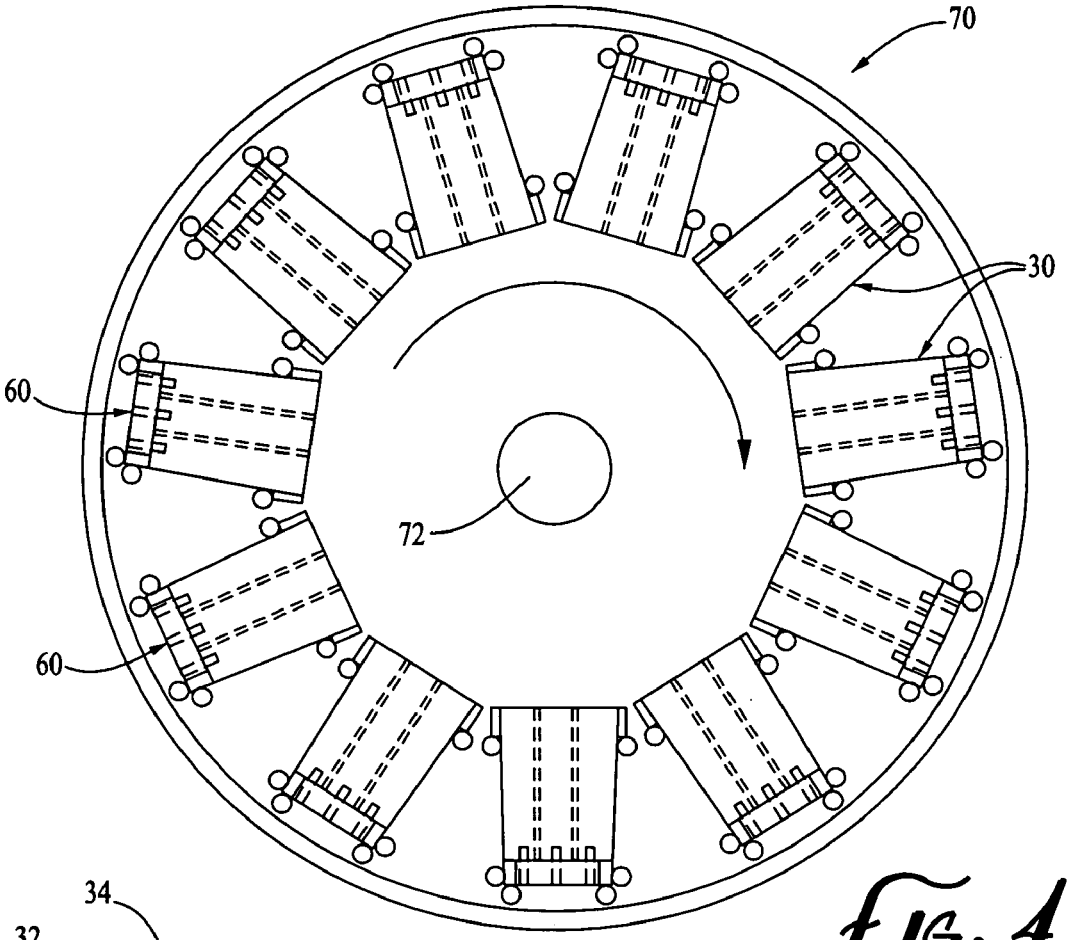
FIG. 4 is a top perspective schematic view of a representative centrifuge apparatus used in the present invention showing ink cartridges arrayed along radials with the print head end facing outward.
Figure 5:
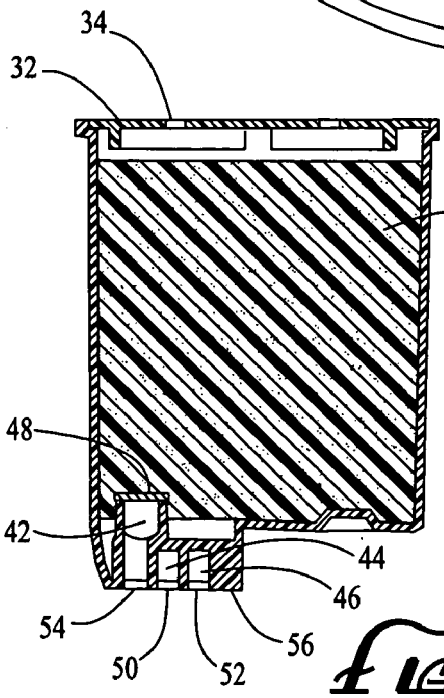
FIG. 5 is a cross-sectional view through a representative ink cartridge body of the present invention.

FIG. 4 is a top perspective schematic view of a representative centrifuge apparatus (70) used in the method of the present invention showing ink cartridge bodies (30) substantially aligned along radials with the print head assemblies (60) facing outward or substantially away from the axis of rotation (72) of the centrifuge rotor. In such an arrangement as shown in FIG. 4, rotation of the centrifuge (70), as indicated by the curved arrow, produces a centrifugal force which is in the same direction as that in which ink droplets are ejected from the print head arrays, which is highly preferred to overcome the "air lock" problem previously described. Adoption of the process and techniques of the present invention has resulted in a reduction of failure to print defects due to "air lock" of more than 70% compared with conventionally recharged ink cartridges which have not been subjected to centrifugation in the manner as described above.

In the present invention, air is expelled from the ink flow path or course from the reservoir (39), (40) or (41) to the ink ejection orifices or nozzles (not shown) by centrifuging the cartridge body (30) containing a predetermined quantity of water or other ink miscible liquid for a predetermined time in a plane substantially perpendicular to the axis of rotation (72) of centrifuge (70) in an orientation with the print head facing radially outward or substantially away from the axis of rotation of the rotor of the centrifuge (70). This procedure or process forces the liquid from the reservoir (39), (40) and (41) through the cartridge ink channels (44), (42) and (46) to the microchamber arrays of the print head assembly (60) and thence out of the print head through the orifices or nozzles (not shown) thus purging or venting air entrapped or entrained at any location between the ink reservoir (39), (40) and (41) and the microchamber array (62), (64) and (66) out through the ink ejection orifices or nozzles (not shown) to establish a continuous fluid connection between the reservoir and the print head. As used herein, the term fluid connection means that a liquid, forms a continuous liquid path or connection between the elements mentioned. For example, notwithstanding that there is a fluid communication between the fuel tank and carburetor of an automobile, there exists no fluid connection between the fuel tank and carburetor when the automobile has run out of fuel and the fuel tank and fuel lines have thus been drained of fuel. Accordingly, fluid communication is a matter of structural design, whereas fluid connection is a statement defining a physical condition.

Figure 3:
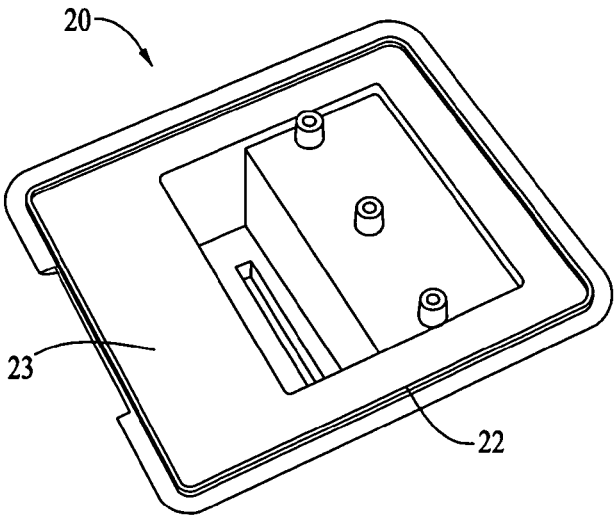
FIG. 3 is a bottom perspective view of an ink cartridge replacement cap.

With reference to FIGS. 2 and 3, cartridge cap (20) is formed with an energy director element (22) around the periphery of its lower surface (23) which interfaces with rim (24) of cartridge body (30). Joining of cap (20) to cartridge body (30) is accomplished by ultrasonic welding of energy director element (22) to rim (24) by means of a conventional ultrasonic welding apparatus such as is available from Branson Ultrasonics Corporation, Danbury, Conn.

The replacement cartridge cap (20) (FIGS. 1–3), which may be keyed or keyless, of the present invention is configured so as to permit the recharged ink cartridge to be used in the inkjet printers of a wide variety of printer manufactures. Most inkjet printer cartridge original equipment manufactures provide a particular geometric or conformational "key" in the cartridge cap which mates with a complementary receptacle in the printer and allows only use of that manufacture's ink cartridges in its printers. The limitation that only a particular manufacture's ink cartridge may be used in its printers is overcome by the replacement cartridge cap of the present invention by adoption of a cap configuration avoids the "key" feature of printer receptacles and which permits the recharged and resealed ink cartridge to be installed and used in a variety of different manufactures' inkjet printers. With reference to FIGS. 1 and 2, replacement cartridge cap (20) is configured without a "key" feature, but rather is configured to mate with a variety of different cartridge receptacles to form a virtual generic recharged and resealed ink cartridge.

With further reference to FIGS. 1 and 2, cartridge replacement cap (20) is formed with a cap crown (21) and a cap platform (29) extending from and above its upper surface (25). The cap crown (21) has an essentially truncated tapered rectangular solid external three dimensional shape with a flat top surface (26). The cap upper surface (25) and cap crown top surface (26) define essentially parallel planes. Front surface (27) and rear surface (28) (not shown) of cap crown (21) form substantially flat surfaces. In contrast to the flat front surface (27) and rear surface (28) of the cap crown (21) of the present invention, the cap crowns of original equipment inkjet cartridge manufactures, as well as the cap crowns of reprocessed and resealed inkjet cartridges of cartridge remanufactures, are not flat surfaces, but include and contain features of various geometric shape, size and configuration extending from either or both of the corresponding front and rear surfaces of their cap crowns. The aforesaid geometric features on the original equipment cap crowns and the remanufactured cartridge cap crowns operationally mate with a complementary shaped geometric feature of an inkjet cartridge receptacle of an inkjet printer to allow installation of the ink cartridge into a particular manufacture's inkjet printer only. However, because the cap crown (21) of the present invention has substantially flat front (27) and rear (28) surfaces, it is able to avoid steric interference with conventional inkjet printer cartridge receptacles and to operationally interface with a variety of different inkjet printer cartridge receptacles. Thus, the reprocessed and resealed ink cartridges of the present invention may be installed and used in different manufactures' inkjet printers, notwithstanding that the original equipment cartridge from which it was derived was originally manufactured to be able to be installed in only one manufacture's printers.

The Resealing Process

The steps and procedures of the most preferred method of reconditioning, recharging and resealing the ink cartridge of the present invention are described below.

Initially, the empty ink cartridge is first inspected for visual damage to determine whether it appears suitable to be reconditioned and recharged. The print head assembly (60) located on the cartridge body (30) is then soaked in water or in a cleaning solution containing a surfactant to re-wet and remove residual ink from the components of the print head assembly (60). A cleaning solution suitable for this purpose is Clean Jet 4000 available from Formulabs (Kimberly-Clark) which is preferably diluted 1:2 with water. After soaking, the print head assembly (60) is tested to determine whether each color array (62), (64) and (66) will leave a full impression on blotter paper. If the cartridge passes this test, it is then partially disassembled by removal of the cartridge cap (20) from the cartridge body (30). If the cartridge does not pass this test, a determination is made whether to repeat the soaking step or to discard the cartridge, based on the impression made on the blotter paper.

Next, water, or an aqueous cleaning solution, containing a surfactant, such as Clean Jet 4000 is introduced into each ink reservoir (39), (40) and (41) of the cartridge body (30) through a probe or needle inserted through a port (34) existing in each ink reservoir. The water or cleaning solution is introduced at a temperature in the range of 100° F. to 140° F. with 120° F. being preferred. The water or cleaning solution purges and flushes each reservoir and overflows the cartridge for a predetermined time, up to about 10 minutes. Intermittently during the purging step, a suction is briefly applied to the print head assembly to draw the water or cleaning solution through the ink microchambers and orifices. If a cleaning solution has been used during this flushing step, the final purging or flushing is made with plain water to flush out residual cleaning solution. Introduction of the final water flush and the suction on the print head is stopped in a coordinated manner to allow a predetermined amount of water to remain in each reservoir.

Following the final purge or flush, the cartridge body (30) containing a predetermined quantity of water is then placed in a centrifuge (70) and oriented so that the print head assembly (60) portion of the cartridge is facing outward or away from the axis of rotation (72) of the centrifuge (70). The centrifuge is then operated at a predetermined rotational speed for a predetermined period of time found to minimize product defects resulting from entrained air bubbles in the ink causing interruption of ink flow and failure to print. It is believed that centrifugation as described with the print head assembly (60) facing substantially away from the axis of rotation (72) is effective to solve the "air lock" problem because the centrifugal force causes air in the ink channels between the porous elements (50), (52) and (54) and their respective ink channel filter elements (48) (only one shown in cross-section) to be displaced or purged by the liquid. It is also believed that liquid forced through the three ink channel porous elements by the centrifugal force displaces air entrained in the porous elements (50), (52) and (54) as well as air present in the print head assembly (60) components causing it to be expelled, vented or purged through the orifice arrays. Additionally, it is believed that the flow of water through the orifice arrays due to the centrifugal force results in a continuous liquid path from the orifice arrays through the ink channels to the ink reservoirs.

EXAMPLE

For example, in the case of one of the common style ink cartridges such as the Lexmark 15M0120 depicted in stylized form in FIGS. 1–6, it has been found that the best results with respect to resolving the "air lock" problem are achieved when the cartridge is centrifuged in a Simmons, model Typ 776 SEC 090 centrifuge with the standard "bucket" rotor, having a radius of approximately 10 inches, at 2800 rpm for three minutes. In this case, with this common cartridge, it has also been determined that addition of about 38 gm of water to the cartridge prior to the centrifugation step, is optimal from the point of being sufficient to displace entrained or entrapped air from the print head array and ink channels as well as to provide a sufficient continuous fluid connection from the print head array to the ink channel filter or porous element to prevent "air lock". Under the parameters described, upon completion of the centrifugation step approximately 3 to 6 gm of fluid remains in the cartridge. This residual water remaining in the cartridge has been found to provide a continuous liquid path from the ink ejection orifices or nozzles of the print head array microchambers and connected ink channels through the ink channels to the filter elements.

Following removal from the centrifuge (70), each reservoir (39), (40) and (41) of cartridge body (30) is filled or recharged with the appropriate color ink through a probe inserted through a reservoir port (34). Thereafter, the recharged cartridge body (30) is tested to confirm proper functioning of each print head (62), (64) and (66).

The cartridge body (30) is then mated with a new cartridge cap (20) having an energy director element (22) and the loose assembly is placed into a conventional ultrasonic welding apparatus such as a Branson model 900 available from Branson Ultrasonics Corporation, Danbury, Conn. The welding process requires approximately 1 second, after which the resealed ink cartridge (10) is removed from the ultrasonic welder. Following resealing of the recharged ink cartridge, the finished resealed ink cartridge is subjected to post production quality control testing, after which it is packaged for shipment.

While the present invention has been described in connection with what are present considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A method of making a resealed ink cartridge comprising:

providing a depleted ink cartridge body having an ink reservoir and a print head that is in fluid communication with said ink reservoir;

introducing a cleaning fluid into said ink reservoir;

placing said cartridge body in a centrifuge, wherein said print head of said cartridge is positioned radially outward of its ink reservoir;

centrifuging said cartridge body to cause said cleaning fluid to flow from said ink reservoir into said print head to effect purging of air from said print head through said ink ejection orifices; and stopping said centrifuge when a continuous fluid connection between said print head and said reservoir has been established.

2. The method of claim 1 wherein said step of introducing further comprises:

rinsing said ink reservoir and said print head with said cleaning fluid.

3. The method of claim 2 wherein a second cleaning fluid is introduced at a temperature in the range of 100° F. to 140° F.

4. The method of claim 2 wherein said rinsing is performed for approximately 10 minutes.

5. The method of claim 2 wherein said cleaning fluid is water.

6. The method of claim 2 wherein said cleaning fluid is CleanJet 4000 manufactured by Formulabs (Kimberly-Clark) diluted with water.

7. The method of claim 2 wherein said step of introducing further comprises:

intermittently applying suction to said print head to draw out said cleaning fluid through ink microchambers and orifices of said print head.

8. The method of claim 1 wherein said step of centrifuging is performed at a predetermined rotational speed for a predetermined period of time.

9. The method of claim 1 further comprising:

soaking said print head with a second cleaning fluid prior to said introducing said cleaning fluid into said ink reservoir.

10. The method of claim 9 wherein said step of soaking further comprises:

testing said print head to determine whether said print bead retains residual ink after soaking.

11. The method of claim 9 wherein said second cleaning fluid is water.

12. The method of claim 9 wherein said additional second fluid is CleanJet4000 manufactured by Formulabs (Kimberly-Clark) diluted with water.

13. The method of claim 1 further comprising:

recharging said cartridge body with ink.

* * * * *